United States Patent [19]

Ono et al.

[11] 4,044,570

[45] Aug. 30, 1977

[54] REFRIGERATOR

[75] Inventors: Minoru Ono, Izumi; Sakae Fukuchi, Sano; Syouzou Ogawa, Ohira; Fumio Ishikawa, Utsunomiya; Shigeo Nagakita, Tochigi, all of Japan

[73] Assignee: Hitachi, Ltd., Japan

[21] Appl. No.: 652,664

[22] Filed: Jan. 27, 1976

[30] Foreign Application Priority Data

Feb. 28, 1975 Japan ..... 50-26655

[51] Int. Cl.[2] ..... F25D 17/06; F01D 5/08; F01D 5/18; F01D 25/08

[52] U.S. Cl. ..... 62/419; 415/180

[58] Field of Search ..... 62/419, DIG. 13; 415/180, 178

[56] References Cited

U.S. PATENT DOCUMENTS

| | | | |
|---|---|---|---|
| 2,107,400 | 2/1938 | Stabbal | 62/419 |
| 2,133,818 | 10/1938 | Hulse | 62/419 |
| 2,487,068 | 11/1949 | Morris | 62/419 |
| 2,601,030 | 6/1952 | Klein et al. | 415/180 |
| 2,773,639 | 12/1956 | Wheller | 415/180 |
| 2,959,936 | 11/1960 | Mann et al. | 62/419 |
| 2,982,115 | 5/1961 | Wurtz et al. | 62/419 |
| 3,022,639 | 2/1962 | Brown et al. | 62/419 |
| 3,027,735 | 4/1962 | Preotle et al. | 62/419 |
| 3,094,273 | 6/1963 | Hull et al. | 415/180 |
| 3,307,365 | 3/1967 | Townsend | 62/419 |
| 3,393,530 | 7/1968 | Koch | 62/419 |
| 3,910,717 | 10/1975 | Thome | 415/180 |

*Primary Examiner*—Lloyd L. King
*Attorney, Agent, or Firm*—Craig & Antonelli

[57] ABSTRACT

In the refrigerator according to the present invention, the driving motor is provided outside of the refrigerator and hence the heat load of the freezing cycle can be decreased by the value corresponding to the value of heat which would be generated by the driving motor provided inside of the refrigerator, thereby reducing the time of cooling operation. Additionally, a bush is used to block the gap around the driving shaft penetrating into the refrigerator and hence a complete shut-off is established between the interior and the exterior of the refrigerator. Since the driving motor is housed in a completely sealed housing so that construction of the driving motor free from lock troubles is available. In addition, in the case of construction wherein a liquid polyurethane is filled in the insulated wall of the refrigerator for foam-forming therein, leakage of the liquid polyurethane can be fully prevented.

26 Claims, 4 Drawing Figures

REFRIGERATOR

BACKGROUND OF THE INVENTION

This invention relates to construction of mounting an air blower on a refrigerator, and more particularly is concerned with economizing in electricity costs spent for operation of the refrigerator.

Heretofore, there have been two different concepts on construction of mounting an air blower on the refrigerator of the type in which cooled air is forcedly circulated. The first concept is to mount an air blower itself in the refrigerator, whereas the other concept is the method wherein a driving motor portion of an air blower is provided outside of the refrigerator and only the fan is mounted in the refrigerator.

These two concepts have had both advantages and shortcomings, respectively. In other words, according to the former concept, quanitity of using electricity is increased because even the heat generating portion of the air blower, i.e., the driving motor is mounted in the refrigerator. This is, the heat generated by the driving motor is a reverse action against the cooling of the interior of the refrigerator.

Additionally, if water droplets are attached to the coils or the like of the driving motor portion, then such a condition may serve as the cause of fire. On the other hand, according to the latter concept, the driving motor of the air blower is mounted outside of the refrigerator and only the fan is mounted in the refrigerator and hence the shortcomings inherent to the former method may be obviated. However, the latter has the following defects.

1. Since the driving motor portion is located outside of the refrigerator, there occur necessities for electrical insulation, protection for strength, and for protecting the driving motor portion from insects. In other words, access may be made to the driving motor portion in transit of the refrigerator. Therefore, needless to say there is necessity for taking measures for such access. Furthermore, in case said driving motor portion is directly urged against a wall or the like, said portion may hit against the wall most hard. As the result, there may frequently occur bent or misaligned driving shaft of said driving motor.

2. Since the driving shaft is needed to be increased in length, it is possible that the fan of the air blower be rotated eccentrically to a great extent when said fan is rotated.

3. In the case of mass production, it is difficult to constantly align the axis of the driving shaft with the center of a mouth ring of the air blower mounted inside of the refrigerator.

4. In addition to the above, there may occur necessities for studying various problems on construction of supporting means for the driving motor and the like.

The present invention is intended to obviate the shortcomings described above. According to the present invention, a recessed portion is provided in an outer plate at the upper portion of a cooler, a thin wall portion is locally provided in an insulated wall, a heat generating portion of a fan motor is housed in said recessed portion, a shaft of said fan motor is penetrated through said thin wall portion, a fan is mounted at the forward end of said shaft in such a manner that air intake is made from the side of said thin wall portion to circulate cooled air through the refrigerator, whereby it is intended to attain decrease in heat load by virtue of heat generating performed by the motor provided outside of the generator, extension of the service life of the motor and restriction of heat transmission through the insulated wall which is resulted from the adoption of a thin wall.

DETAILED DESCRIPTION OF THE PREFERRED EMBODIMENTS

Figure 1:
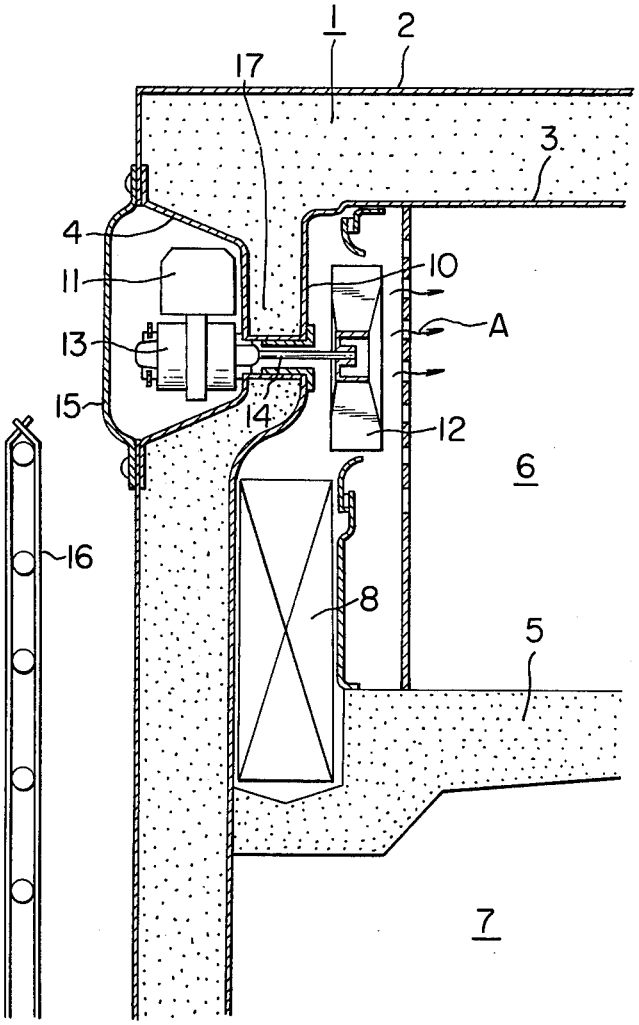
FIG. 1 is a longitudinal sectional view showing the driving motor mounting portion at the rear upper portion of the refrigerator as an embodiment of the present invention.

Description will hereunder be given of an embodiment in which the details of the present invention are shown in the drawings.

Firstly, referring to FIG. 1, designated at the numeral 1 is an insulated wall, 2 an outer plate, and 3 an inner box. Said insulated wall 1 is made of a bad thermal conductor such as a urethane foam filled in a space surrounded by the outer plate 2 and the inner box 3. 6 is a freezing chamber, 7 a refrigerating chamber, and 8 a cooler. The freezing chamber 6 and the refrigerating chamber 7 are constructed such that air is maintained in communication therebetween. 13 is a driving motor comprising a shaft 14 and a coil portion 11. The coil portion 11 is provided outside of the outer plate 2, and the shaft 14 is penetratingly provided through the insulated wall 1. 12 is a fan which is mounted at the forward end of the shaft 14. In other words, the fan 12 is mounted so as to be located within the inner box 3. Additionally, the driving motor 13 is mounted within a recessed portion 4 provided on the rear surface of the outer plate 2 and above the cooler 8. Provided in opposite relation to said recessed portion 4 is the inner box 3 which projects upwardly of the cooler 8, and is formed with a convex portion 10 having a flat portion and connected to other surfaces of the inner box through curved surfaces thereof which gives no extremely, strong resistance as the fluid passages. In addition, the depth of the recessed portion 4 and the height of the convex portion 10 are so determined that the depth of the recessed portion 4 is larger. As the result, the thickness of the insulated wall 1 between the recessed portion 4 and the convex portion 10 becomes thin as compared with other portions. In other words, the shaft 14 of the driving motor 13 extends through the flat portion of the convex portion 10 and the portion of the insulated wall 1, through which said shaft 14 extends, forms with a thin wall portion 17 which is locally thinner than any other portion at the rear and hence the length of said shaft 14 to the mounting position of the fan 12 located in the interior of the inner box 3 becomes shorter. Additionally, the fan 12 is mounted at the rear of the inner box 3 in such a manner that air intake is made from the side of the convex portion 10.

As the result, the air having cooled in the cooler 8 is discharged into the refrigerator in the direction indicated by arrows A by means of the fan 12, whereby the freezing chamber 6 and the refrigerating chamber 7 are cooled. 15 is a cover for the driving motor 13 for minimizing the effects of the radial heat generate by a condenser 16 and the heat by convection. The driving motor 13 and the condenser 16 are arranged such that the upper end surface of the condenser 16 is positioned lower than the height of the driving motor 13.

In the refrigerator of construction described above, while the compressor (not shown) operates, the condenser 16 gives out radiant heat through the agency of the freezing device known in the art, the cooler 8 absorbs heat to lower the air temperature in the refrigerator, and the driving motor 13 rotates to cause the fan 12 to circulate the cooled air through the freezing chamber 6 and the refrigerator chamber 7 whereby the interior of the refrigerator is cooled. At this time, the heat load of the driving motor 13 having been in the refrigerator and generating heat therein is eliminated because the driving motor is moved into the recessed portion 4 and the resultant reduction in heat load can be reflected in correspondingly decreased freezing capacity for maintaining the respective temperatures in said both chambers at the respective predetermined levels. On the other hand, the overall heat transmission value through the thin wall portion 17 is increased as compared with the case that the driving motor 13 was provided in the refrigerator. Accordingly, the less the increased heat value through the thin wall portion 17 is, the more the effect becomes greater which is resulted from the fact that the coil portion 11, the heat generating portion of the driving motor 13, is taken out of the refrigerator. From a common sense point of view, it should be avoided to make the insulated wall to be thinner for this purpose. As described above, the thickness should be determined in consideration of the service life of the driving motor 13. The present invention has a secondary object to minimize a penetrating heat value to be increased through the aforesaid portion in the case that the thickness of the thin wall portion 17 is determined at a certain value. To give description of this point, since the thin wall portion 17 is disposed above the cooler 8, at the time of the fan 12 being stopped, the difference in temperature between outside and inside of the refrigerator is small as compared with the case that the thin wall portion is disposed below the cooler 8 or at the rear of the cooler 8, thereby decreasing the overall heat transmission value. Additionally, as viewed from the exterior of the refrigerator, the thin wall portion 17 is not only located at the upper portion where the radiant heat from the condenser 16 is difficult to reach but also has the cover 15 shield the radiant heat and control the rise of the surface heat transfer rate resulted from the convection rising along the rear surface of the outer plate 2, so that the effects similar to the above may be obtained.

The most significant feature resides in that the fact that the air flow rendered by the fan 12 is taken in from the side of the convex portion 10 and the fact that the center of the fan 12 is located at the flat portion of the convex portion being formed with smoothly curved surfaces are coupled to bring about such a effect that the air speed along the surface of the inner box 3 is relatively decreased in the vicinity of the portion, through which the shaft 14 extends, and in which the highest heat penetration is expected during rotation of the fan 12, thereby decreasing the overall heat transmissiion value therein.

As described above, according to the present invention, the driving motor 13 is disposed in the recessed portion 4 in such a manner that the shaft 14 extends through the thin wall portion 17 and hence, even with the driving motor 13 which are controllable under the present mass production system, the coil portion 11, the heat generating portion of such driving motor, can be mounted outside of the refrigerator so that the corresponding freezing capacity can be decreased and the resultant effect in economizing quantity of electricity can be expected. Additionally, since the thin wall portion 17 is disposed well above the condenser 16 and protected by the cover 15, and positioned above the cooler 8 so that the difference in temperature between the interior and the exterior of the refrigerator in the vicinity of the thin wall portion 17 can be relatively decreased, thereby enabling to minimize the negative effect by the thin wall.

As apparent from the foregoing, according to the present invention, in the refrigerator of the forced convection type wherein a fan is used, the driving motor accounting for the large portion of the heat load of the refrigerator can be mounted outside of the refrigerator in the most effective manner and hence such significant advantages in practical use are presented that cooling can be attained at the temperatures of predetermined levels with the resultant decrease in operating time of the compressor or the more compact compressor with the resultant decrease in size becomes available.

In passing, in the case that the present invention was applied to a deep freezer with a capacity of about 170 *l*, the heat load corresponding to more than 10% of the heat load of the conventional refrigerator was decreased, thereby attaining the effect in economizing the corresponding quantity of electricity.

Figure 2:
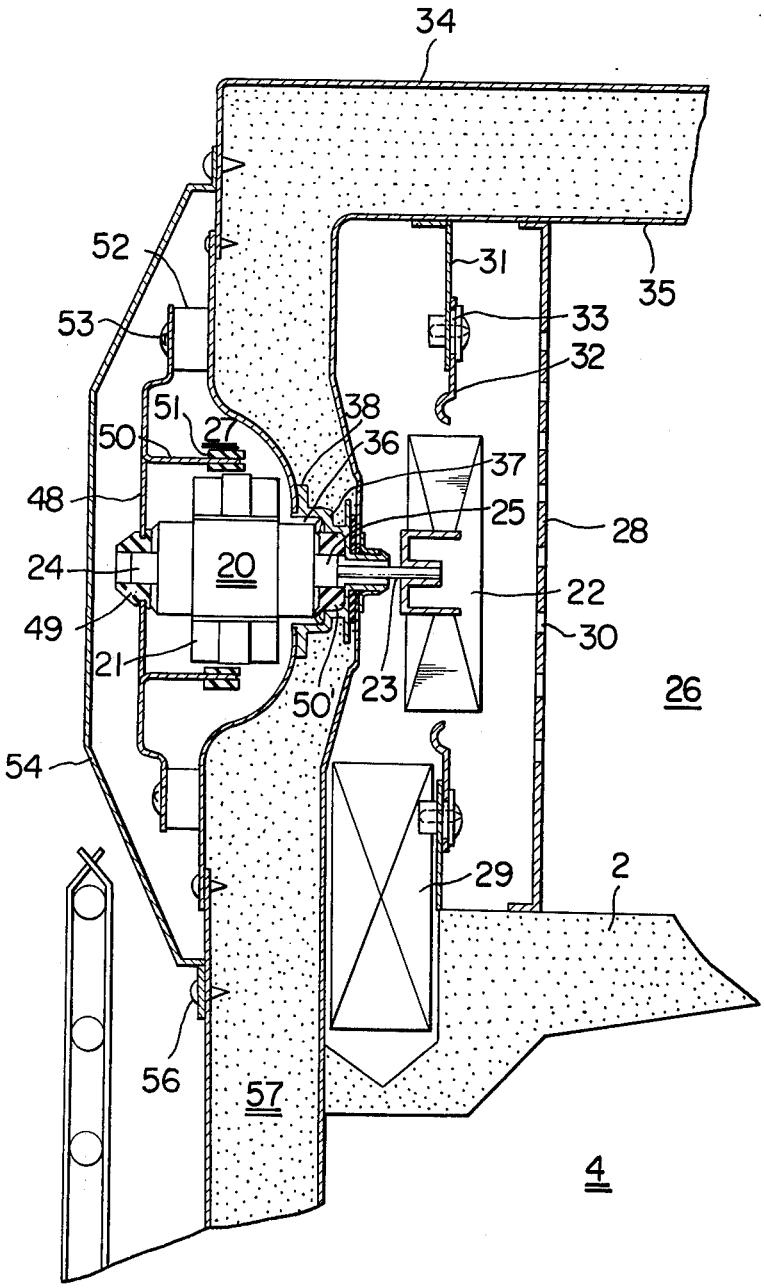
FIG. 2 is a longitudinal sectional view of the driving motor mounting portion as another embodiment of the present invention which is different from one shown in FIG. 1.
Figure 3:
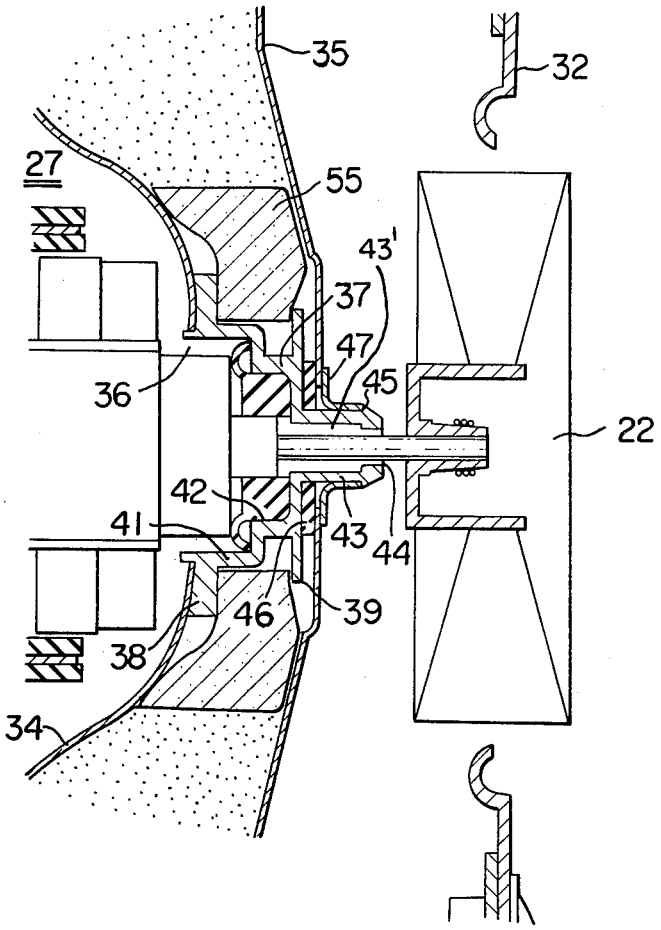
FIG. 3 is a view detailedly showing the essential portions of a communicating pipe used in FIG. 2.

Next, description will hereunder be given of the detailed arrangement of the mounting of said driving motor in the recessed portion with reference to FIG. 2 and FIG. 3. Designated at the numeral 20 is the main body of a air blower comprising a driving motor 21, a fan 22, a driving shaft 23, brackets 24, 25 and so forth. As shown in the drawings, the fan 22 is disposed in the freezing chamber 26, and the driving motor 21 is mounted in the recessed portion 27 provided at the rear of an outer box which will be described hereinafter.

28 is an air outlet grill mounted in front of the fan 22 and provided therein with slits 30 through which the air cooled in an evaporator 29 and blown out of the fan 22 is passed.

31 is an adapter plate, 32 a mouth ring mounted on said adapter plate by means of screws or the like. Since said mouth ring 32 is provided therein with slits 33 so that said mouth ring is adjustable according to the position of said fan 22. In other words, said mouth ring 32 is adapted to absorb the displacement of the fan 22 due to the misalignment of the driving shaft 23 resulted from the error during assembly work of the air blower in the process of mass production. 27 is a recessed portion provided at the rear of said outer box 34. Said recessed portion 27 is recessed toward the inner box 35. The portion of the insulated wall where said recess is provided is thin as compared with other portions of the insulated wall. 36 is a hole provided in said recessed portion, and a hole in opposite relation to said hole 36 is provided in the inner box 35. 37 is a communicating pipe provided in the portion of said hole 36. As shown most clearly in FIG. 3 of the drawing, said communicating pipe 37 is closely attachingly secured to the outer box 34. The communicating part 37 includes an outer collar 38 for securing the communicating part 37 to the outer box 34, an inner collar 39 maintained in intimate contact with the inner box 35 through a packing 46, a stepped portion 41, 42 interposed between the outer collar 38 and the inner collar 39, and a tubular guide portion 43 extending from the inner collar 39 into the compartment of the refrigerator. The guide portion 43 is formed therein with a bore 43' for permitting the drive shaft 23 to extend therethrough, a projection 44 extending inwardly from the bore defining inner wall surface of the guide portion 43 to narrow the bore 43' so as to provide a steady rest for the drive shaft, thereby preventing wobbling of the drive shaft 23, with an engaging portion 45 provided on the outer periphery of the forward end of the guide portion 43. 47 is a speed nut which is mounted between said engaging portion 45 and the inner box 35 in order to stop said inner box from being caused to shift inwardly of the refrigerator when said communicating pipe 37 is mounted between the outer box 34 and the inner box 35 and a polyurethane foam of foam-forming in situ is filled. In FIG. 2, 48 is a keep plate provided at the central portion thereof with a first rubber seat 49. 50 is a support plate integrally provided on said keep plate 48 for positioning the driving motor, and has a buffer member 51 at the forward and thereof. Said keep plate 48 is secured through a further rubber seat 52 to the outer box 34 by means of screws 53 or the like. 50' is an additional rubber seat which is disposed between the step portions 41, 42 of said communicating pipe 37 and the bracket 25 of the portion of driving motor 21, preventing leakage of cooled air through the communicating pipe 37 to outside of the refrigerator and fixedly supporting one end of said driving motor 21. In addition, the bracket 24 at the other end of the driving motor 21 is coupled into said rubber seat 49. 54 is a cover solidly secured to the outer box 35 by means of screws 56 for shielding the driving motor 21 from the open air.

In FIG. 3, 55 is a seal member made of a synthetic resin foam product or the like and being clamped between said outer collar 38 and the inner collar 39 by use of its own resiliency, absorbing freon gas generated at the time of filling a foam-forming insulating material 57 and preventing the generation of voids in the vicinity of the portion where said seal member is provided, i.e., in the vicinity of the communicating pipe 37. Although the seal member 55 is provided for preventing the generation of voids, the seal member can be dispensed with if some measure is taken with the communicating pipe. Additionally, if a gas breather is provided utilizing the communicating pipe portion, it can serve as an inlet through which the original liquid of polyurethane foam of foam-forming in situ is filled.

With the refrigerator of construction described, in the case of mounting the main body of the air blower 20, the following procedure should be followed. Firstly, a bracket 24 is coupled to the hole provided at the central portion of a rubber seal 49 mounted on the keep plate 48, thereafter the driving shaft 23 is inserted in such a manner that a bracket 25 is previously coupled into a hole of the rubber seat 50' provided on the side of the communicating pipe 37, and thereafter the keep plate 48 is solidly secured to the outer box 34 through the rubber seat 52. At this time, according to the present invention, the communicating pipe 37 and the driving motor portion 21 are arranged such that the forward end of the driving motor portion 21 is inserted into the communicating pipe 37 as shown in the drawing. In other words, the forward end of the bracket 25 is disposed at a position very close to the interior of the refrigerator. Consequently, the length of the driving shaft 13 according to the present invention can be made very short as compared with the driving shaft for the conventional air blower of the type provided outside of the refrigerator.

When cooling operation is made with the refrigerator having the arrangement of the mounting of the air blower of the type described, the heat generated by the driving motor does not penetrate into the refrigerator and is emitted into the open air through the outer box of the refrigerator or the cover 54, whereby the corresponding quantity of electricity for use can be decreased as compared with the conventional refrigerator.

Figure 4:
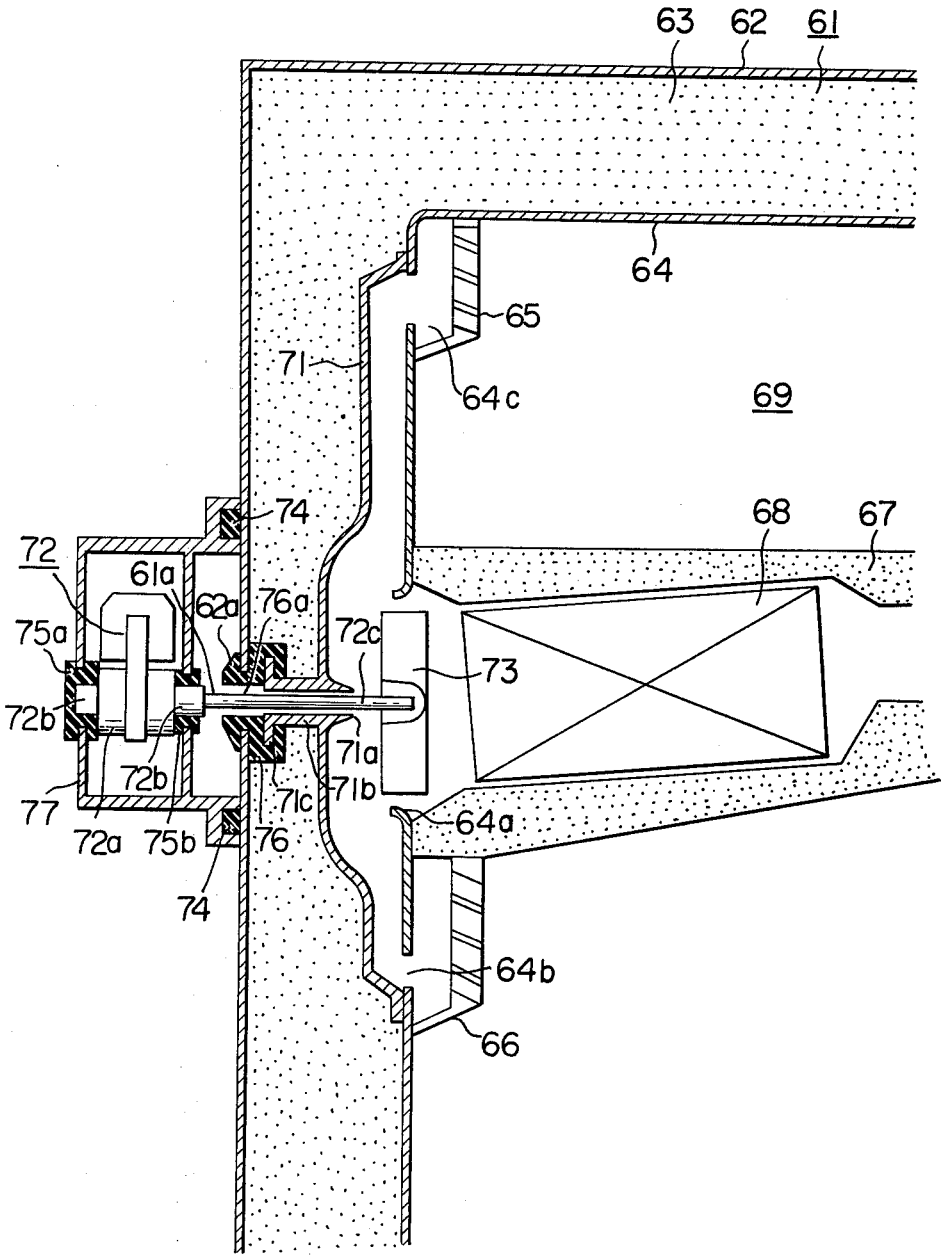
FIG. 4 is a longitudinal sectional view of the driving motor mounting portion as a further embodiment of the present invention which is different from FIG. 1 and FIG. 2.

Further, description will hereunder be given of another embodiment realizing the object of the present invention with reference to FIG. 4. Designated at the numeral 61 is the main body of a refrigerator comprising an outer plate 62, an insulated wall 63, an inner box 64 and so on. 72 is an air blower intergrally provided thereon with a driving motor portion 72*a*, a support shaft 72*b* supporting said driving motor portion, and a driving shaft 72*c* extending out from the driving motor portion and engaging a fan 73 for forced circulation of cooled air at the forward end thereof. The driving motor portion 72 is supported by grommets 75*a*, 75*b* being insertingly engaged in a housing at the support shaft porton 72*b*. A packing 74 is press-fitted between said housing 77 and the outer plate 62, and said housing 77 is closely attachingly secured to the outer plate 62 by means of screws (not shown) or the like. Additionally, the driving shaft 72*c* extends out from the housing through a through-hole 61*a* provided in the main body of the refrigerator and is present in the refrigerator. Said through-hole 61*a* consists of: a communicating pipe portion 71*b* integrally formed with a duct 71 which will be described hereinafter; and a through-hole 62*a* of the outer plate 62. Said communicating pipe 71*b* and the through-hole 62*a* are blocked therebetween and solidly secured to each other by means of a bush 76. Additionally, a bush inserting flange 71*c* is provided at the forward end of the communicating pipe portion 71*b* to facilitate the engagement of said bush 76. In addition, said bush 76 is press-fitted into the outer plate 62 and the bush inserting flange 71*c* of the communicating pipe while remining a certain flexibility so as to completely blocking between the interior and the exterior of the refrigerator. Said duct 71 forms a cooled air passage for the suction of air cooled in the cooler 68 which is forced by the fan and the discharge of cooled air through the discharge outlet 64*c* or 64*b*, and is closely attachingly secured to the rear surface of the inner box. In addition, a contracted hole 64*a* serving as a bell-mouth of the fan 73 is integrally provided in the inner box 64 around the position in which said fan 73 is placed. 67 is a partition wall in which said cooler 68 is housed and dividing the interior of the refrigerator into two sections includin a freezing chamber 69 and a refrigerating chamber 70. 65 and 66 are air directing plates directing cooled air discharged from the cooled air discharge outlets 64*c* and 64*b* and additionally serving as the face covers for those discharge outlets.

As has been described above, according to the present invention, the driving motor portion is provided outside of the refrigerator, the driving shaft extends through a through-hole 61*a* formed by the communicating pipe portion and the through-hole of the outer plate and is present in the refrigerator, the fan for forced circulation of cooled air is engaged with the forward end of said driving shaft, the contracted hole serving as the bell-mouth of the fan is provided in the inner box around said fan so that the heat load of the freezing cycle can be decreased by the value which corresponds to the value of heat which would be generated by the driving motor provided inside of the refrigerator, thereby reducing the time of cooling operation. Additionally, since the bell-mouth is integrally provided in the inner box, mounting work for the fan and the like can be simplified, thereby reducing the production costs. Additionally, the driving shaft penetrating portion is formed by the communicating pipe portion formed integral with the duct, said communicating pipe portion and the through-hole of the outer plate are blocked therebetween and solidly secured to each other by means of the bush and hence the interior of the insulated wall is completely shut off from the interior or exterior of the refrigerator and air is not allowed to move therethrough, thereby preventing the deterioration in thermal isolation performance and leakage of cooled air from the refrigerator. In addition, since the driving motor portion is sealingly housed by means of the grommets and said housing is press-fitted to the outer plate by means of the packing 74, the possibility of direct access to the driving motor portion is eliminated and, at the same time, dusts and insects are prevented from entering the drive motor portion so that construction of the driving motor portion free from lock troubles can be obtained. Additionally, air in the refrigerator is not allowed to get out through the gap of the through-hole so that leakage of cooled air in the refrigerator can be prevented.

As described above, in this embodiment as well, the defects and dangers experienced with conventional refrigerators are all eliminated so that construction which is effective from the viewpoint of production cost can be obtained. In addition, in the case of construction wherein liquid polyurethane is filled into the insulated wall of the refrigerator for foam-forming, the communicating pipe portion and the through-hole portion of the outer plate are locked therebetween and solidly secured to each other by means of the bush and hence leakage of the original liquid of polyurethane can be fully prevented.

Since the present invention has construction described above, not only the defects which were originally expected of taking the driving motor portion out of the refrigerator, such as eccentricity of the shaft and various problems about seals, support construction for the driving motor and the like can be eliminated but also the measures can be taken which include electrical insulation, protection for strength and preventing insects and the like from entering the driving motor portion. Moreover, the refrigerator which requires low quantity of electricity for use.

What is claimed is

1. A refrigerator comprising at least one refrigerating chamber means defined by an outer box and an inner box spaced therefrom, foam insulating material filling the space between said outer and inner box, and an air blower including a fan and a driving motor for circulation of cooled air in the at least one refrigerating chamber means, characterized in that:

a recess means is provided in a rear portion of said outer box for accommodating the driving motor;

a pipe means is provided for communicating said recess means with the at least one refrigerating chamber means;

a drive shaft means is provided on the driving motor and extends through said pipe means, the fan is mounted at a forward end of said drive shaft means on a side thereof facing the at least one refrigerating chamber means;

means are provided in said pipe means for guiding the drive shaft means therein to ensure a steady, non-wobbling positioning thereof, the driving motor includes a main body portion and bracket portions provided at opposite longitudinal sides of said main body portion, means are provided for mounting said bracket portions at said recess means including:

an adapter plate means mounted at said outer box, a first rubber seat means mounted at said adapter plate means for accommodating one of said bracket portions, a second rubber seat means arranged in said pipe means for accommodating the other of the bracket portions of the driving motor and for preventing leakage of cooled air through said pipe means, a third rubber seat is interposed between opposite ends of said adapter plate means and the outer box means, and in that means are provided at the outer box for covering the driving motor and the adapter plate means.

2. A refrigerator according to claim 1, characterized in that:

a mouth ring means for absorbing eccentric rotation of said drive shaft means is provided at the refrigerating chamber means and surrounds the fan.

3. A refrigerator according to claim 1, characterized in that said means for guiding the drive shaft means includes a tubular guide portion provided in said pipe means defining a bore for receiving the drive shat means, and projection means are arranged at a forward end of said guide portion along an inner surface of said bore for narrowing the diameter of the bore at least at the forward end thereof.

4. A refrigerator comprising an outer box, an inner box, foam insulating material filling a space defined between said outer and inner box, said material beig foam-formed in situ, and an air blower having a fan and a driving motor for circulation of cooled air in said refrigerator, characterized in that:

in forming of the boxes of the refrigerator;

a recessed portion recessed inwardly of the refrigerator is provided at the rear portion of the outer box of the refrigerator;

a hole is provided in the outer box portion in which said recessed portion is formed;

a hole is provided in the inner box portion being in opposite relation to said hole;

in order to connect said two holes, a communicating pipe communicating between the exterior and interior of the refrigerator is provided between the outer box and the inner box at a portion of the outer box wherein said recessed portion is provided, the driving motor is provided in said recessed portion in such a manner that the driving shaft thereof extends through said communicating pipe;

the fan is mounted at the forward end of said driving shaft on the side of the interior of the refrigerator;

the communicating pipe having an outer collar, an inner collar and step portions provided between the outer box and the inner box, said inner collar being provided at the forward end thereof with shaft support portions and the like;

a seal member made of a synthetic resin foam-forming product or the like is clamped around said communicating pipe and between the outer collar and the inner collar;

thereafter a foam-forming insulating material is filled in the space defined between the outer and inner box.

5. A refrigerator comprising at least one refrigerating chamber means defined by an outer box and an inner box spaced therefrom, foam insulating material filling the space defined between said inner and outer box, an air blower having a fan mounted on a drive shaft of a driving motor for circulation of cooled air, and an evaporative cooler means, characterized in that:

a housing means is arranged on a rear portion of the outer box for accommodating said driving motor;

an opening means is provided in said outer box for communicating said housing means with an interior of said at least one refrigerating chamber means;

means for mounting said driving motor at said housing means such that the drive shaft thereof extends through said opening means with the fan being arranged in proximity to the evaporative cooler means;

a pipe means arranged in said opening means for receiving the drive shaft of the driving motor;

a duct member integrally formed with said pipe means and interposed between said inner box and said outer box, said duct member being recessed in a direction toward said housing means at least within the area of said housing means so as to define an air flow passage between said duct member and a portion of said inner box;

means for mounting said pipe means and said duct member at said outer box;

a contracted hole means formed in said inner box at least within the area of the recessed portion of said duct member for forming a bell mouth for the fan mounted on the drive shaft;

and means provided at said air flow passages for communicating said air flow passage with the at least one refrigerating chamber means, whereby air is drawn over the evaporative cooler means by said fan and directed through said air passage to said refirgerator chamber means.

6. A refrigerator according to claim 5, characterized in that said pipe means includes an annular collar arranged on an outer periphery thereof, and in that said means for mounting said pipe means includes a bush means press fitted into said opening in said outer box and surrounding said annular collar.

7. A refrigerator according to claim 6, characterized in that the drive motor includes shaft support portions arranged at longitudinal sides thereof, said housing means includes a partition wall dividing the same into at least two chambers, and in that said means for mounting the driving motor at said housing means includes grommet means surrounding said support shaft portions and mounting the same in holes provided in said housing means and said partition wall.

8. A refrigerator according to claim 7, characterized in that packing means are interposed between said housing means and said outer box such that, upon arranging said housing means at said outer box, said housing means is sealed with respect to the environment.

9. A refrigerator according to claim 5, characterized in that said means for mounting the driving motor at said housing means includes grommets surrounding portions of the driving motor.

10. A refrigerator according to claim 5, characterized in that a packing is interposed between the housing means and the outer box when the housing means is mounted on the outer box.

11. A refrigerator comprising an inner box defining a compartment, an outer box arranged in spaced enclosing relationship with said inner box, a foam-forming insulating material filled in the space between said inner box and said outer box, and a blower means including a fan disposed in said compartment and a drive motor having a drive shaft to which said fan is secured, wherein the improvement comprises:

a recess formed in said outer box for mounting said drive motor therein; and a communicating means disposed in said recess and connecting said inner box to said outer box for accommodating the drive shaft, said communicating means comprising:

a tubular guide portion extending through the inner box into said compartment, said tubular guide portion being formed therein with a bore for permitting the drive shaft of the drive motor to extend therethrough, a stepped portion contiguous with said guide portion and interposed between said inner box and said outer box, said stepped portion being formed therein with a bore of a larger diameter for supporting a bracket of the electric motor through a rubber seat, and a projection formed on the inner surface of said tubular guide portion and extending inwardly to narrow said bore so as to prevent a wobbling of the drive shaft.

12. A refrigerator according to claim 11, wherein said inner box includes a convex portion having a smooth surface arranged such that said guide portion of the communicating means is disposed in a central portion of said convex portion, and wherein said fan is adapted to cause air to pass in a streamline flow from said convex portion toward the compartment.

13. A refrigerator according to claim 11, wherein said recess has a smooth curved surface.

14. A refrigerator according to claim 13, including a heat radiating member, wherein the heat radiating member is arranged at the refrigerator at a position spaced from said recess.

15. A refrigerator according to claim 11, further comprising a flexible foamed member arranged between said inner box and said outer box surrounding said communicating means.

16. A refrigerator according to claim 11, wherein an engaging portion is formed at the outer periphery of said communicating means at a forward end thereof, and a speed nut is mounted between the engaging portion and the inner box to hold the communicating means in place in the inner box.

17. A refrigerator according to claim 11, further comprising an adjustable mouth ring arranged in the compartment to surround said fan so as to compensate eccentric rotation of said drive shaft.

18. A refrigerator according to claim 11, wherein said communicating means is arranged substantially centrally of the recess.

19. A refrigerator comprising at least one refrigerating chamber means defined by an outer box and an inner box spaced therefrom, foam insulating material filling the space between said outer and inner box, and an air blower including a fan and a driving motor for circulation of cooled air in the at least one refrigerating chamber means, characterized in that:

a recess means is provided in a rear portion of said outer box for accomodating the driving motor;

a pipe means is provided for communicating said recess means with the at least one refrigerating chamber means;

a drive shaft means is provided on the driving motor and extends through said pipe means, the fan is mounted at the forward end of said drive shaft means on a side thereof facing the at least one refrigerating chamber means;

means are provided in said pipe means for guiding the drive shaft means therein to ensure a steady, non-wobbling positioning thereof;

and in that means are provided for positioning said pipe means at said recess means including a first collar means arranged at a first end of said pipe means on an outer periphery thereof for engagement with a portion of said outer box wherein said recess means is provided, and means provided at the other end of said pipe means on an outer periphery thereof for engaging a fastening means.

20. A refrigerator according to claim 19, characterized in that said pipe means includes a second collar means spaced from said first collar means in a direction toward said engaging means, and in that a seal means is accommodated between said first and second collar means for absorbing a gas generated during a filling of the foam insulating material between said inner and outer box.

21. A refrigerator according to claim 20, characterized in that said seal means is a seal member surrounding said pipe means formed of a synthetic resinous foam material.

22. A refrigerator according to claim 20, characterized in that a packing means is interposed between said second collar means and an inner surface of said inner box.

23. A refrigerator according to claim 20, characterized in that said guiding means further includes a first step portion contiguous with said tubular guide portion defining a bore having a larger diameter than the bore of the tubular guide portion for accommodating a mounting means of the driving motor.

24. A refrigerator according to claim 23, characterized in that said driving motor includes a mounting bracket arranged at at least one longitudinal end thereof, and in that a rubber seat is arranged at such mounting bracket and serves as the mounting means accommodated in said first step portion.

25. A refrigerator according to claim 23, characterized in that a plate means is secured to said outer box for postioning said driving motor at said recess means, and in that said plate means includes an aperture means for accommodating a mounting means of said driving motor.

26. A refrigerator according to claim 25, characterized in that said driving motor includes a mounting bracket at each longitudinal end thereof, and in that a rubber seat is arranged at each of said mounting brackets which serve as mounting means respectively accommodated in said aperture means and said step portion.

* * * * *